US005095571A

United States Patent [19]

Sargent

[11] Patent Number: 5,095,571

[45] Date of Patent: Mar. 17, 1992

[54] UNDERWATER VACUUM CLEANER

[75] Inventor: Ronald J. Sargent, Escondido, Calif.

[73] Assignee: Hydrafun Corporation, Escondido, Calif.

[21] Appl. No.: 602,423

[22] Filed: Oct. 22, 1990

[51] Int. Cl.[5] ..... E04H 3/20

[52] U.S. Cl. ..... 15/1.7; 210/169

[58] Field of Search ..... 15/1.7, 344; 210/169; 422/100

[56] References Cited

U.S. PATENT DOCUMENTS

| | | | |
|---|---|---|---|
| 898,456 | 9/1908 | Farnham . | |
| 1,101,541 | 6/1914 | Harrington . | |
| 2,765,275 | 10/1956 | Aaron | 210/16 |
| 3,018,579 | 1/1962 | Girden | 43/4 |
| 3,258,801 | 7/1966 | Campbell | 15/1.7 |
| 3,820,182 | 6/1974 | Vockroth | 15/1.7 |
| 3,965,608 | 6/1976 | Schuman | 43/110 |
| 4,094,031 | 6/1978 | Cellini | 15/1.7 |
| 4,338,697 | 7/1982 | Broadwater | 15/1.7 |
| 4,584,733 | 4/1986 | Tietge et al. | 15/1.7 |
| 4,724,566 | 2/1988 | Fawcett | 15/1.7 |
| 4,896,392 | 1/1990 | Hull et al. | 15/1.7 |
| 4,935,980 | 6/1990 | Leginus et al. | 15/1.7 |
| 4,944,101 | 7/1990 | Goble | 15/1.7 |

*Primary Examiner*—Edward L. Roberts

*Attorney, Agent, or Firm*—Nydegger & Associates

[57] ABSTRACT

An underwater vacuum cleaner for cleaning debris from the bottom of a pool has a collection chamber formed with an inlet, an exhaust port and an actuator port. Operatively associated with the actuator port is a reciprocable push button which moves between a seated position wherein the actuator port is closed, and an unseated position wherein the actuator port is opened. With the push button in the seated position, an air lock is created in the collection chamber when the chamber is submerged into the pool. Once the collection chamber is submerged, movement of the push button into its unseated position breaks the air lock and allows water, and debris carried by the water, to enter the collection chamber. The collection chamber is emptied of water for subsequent use, and the collected debris is held trapped in the chamber, by withdrawing the collection chamber from the pool. Specifically, upon withdrawal of the collection chamber from the pool, the push button is pulled into an unseated position by the water draining from the collection chamber through the filtered exhaust port.

11 Claims, 3 Drawing Sheets

UNDERWATER VACUUM CLEANER

FIELD OF THE INVENTION

The present invention pertains generally to pool cleaning equipment. More particularly, the present invention pertains to underwater vacuum cleaners. The present invention is particularly, but not exclusively, useful as a hand operable underwater vacuum cleaner for removing dirt and debris from selected locations on the bottom of a swimming pool.

BACKGROUND OF THE INVENTION

As is well-known, swimming pools and other types of man-made pools have a tendency to collect dirt and debris. This is particularly bothersome when the aesthetics of the pool are disturbed by accumulations of material in the bottom of the pool. Further, it is also well-known that if the material is allowed to remain in the pool it can eventually cause discoloration of the water and, in the case of swimming pools, cause a deterioration of the pool's water quality to the point where it is unhealthy to swim in the pool. In any event, it is preferable, and sometimes necessary, to remove the accumulated dirt and debris from the pool.

It happens, however, that pool cleaning presents certain unique problems. For instance, due to the nature of water it is nearly impossible to clean the bottom of a pool by merely sweeping it. Almost always, the result of sweeping the bottom of a pool is to merely stir up the material from the bottom into the water. The stirred-up material then subsequently settles to the bottom and the process must then be repeated with another unsatisfactory result. Consequently, it is well-known that the best way in which to remove material from the bottom of a pool is to vacuum the bottom.

Several pool vacuum cleaning systems are known. Indeed, many large pool cleaning systems are known which recirculate water in the pool through filters to clean the water. Recirculating cleaners, however, are generally not able to remove the dirt and debris which inevitably collects on the bottom of pools. Consequently, smaller underwater vacuum cleaning systems which are not an integral part of the pool's water circulation system are employed for this purpose. These smaller pool-independent systems, however, are generally not self-contained and must commonly rely on pressurized water from an external source to generate a vacuum. More specifically, a typical underwater vacuum system, which is used primarily to remove dirt and debris from the bottom of a swimming pool, incorporates a device having fluid passageways that directs pressurized water through the device to create fluid flow through a vacuum nozzle on the device. This flow then draws dirt and debris from the bottom of the pool into a collection chamber where it can subsequently be removed from the pool. Typically, such devices require connections with external components to be functional. For instance, one well-known source of pressurized water is a simple water faucet and an attached garden hose. Still, there is the problem of making all of the required connections and insuring that all connections are properly sealed. Moreover, even though they may be operated independently from the pool's water circulation system, many of the presently used underwater vacuum cleaning systems are bulky. Furthermore, in an effort to improve their efficiency for cleaning large areas, they incorporate large vacuum nozzles which are basically inefficient for vacuuming small underwater surfaces, such as steps.

In light of the above, it is an object of the present invention to provide an underwater vacuum cleaner which is self-contained and which is operable without being connected to external components, such as a source of pressurized water. Another object of the present invention is to provide an underwater vacuum cleaner which is able to remove accumulated dirt and debris from areas on the bottom of a pool. Still another object of the present invention is to provide an underwater vacuum cleaner which is manually operable. Yet another object of the present invention is to provide an underwater vacuum cleaner which is relatively light weight and which is easily maneuvered around the bottom of a pool. Still another object of the present invention is to provide an underwater vacuum cleaner which can be easily drained of water. Yet another object of the present invention is to provide an underwater vacuum cleaner which is intermittently operable to allow for relocation of the vacuum cleaner underwater. Another object of the present invention is to provide an underwater vacuum cleaner which is simple to use, relatively easy to manufacture and comparatively cost-effective.

SUMMARY OF THE INVENTION

In accordance with the present invention, an underwater vacuum cleaner for removing debris from the bottom of a pool includes a hollow bulbous submersible collection chamber which is formed with a fluid inlet, an exhaust port and an actuator port. The inlet and the exhaust port are positioned on the wall of the collection chamber while the actuator port is mounted on the end of a long hollow tube which extends from the collection chamber and which connects the actuator port in fluid communication with the collection chamber. The actuator port itself is formed with an opening and a metered orifice, either of which, when open, independently establish an air passageway into the collection chamber. To control the flow of air into the collection chamber, a spring-loaded push button is reciprocally mounted on the actuator port and is urged by the spring into a seated position wherein a seal on the push button closes both the opening and the metered orifice. Initial movement of the push button against the force of the spring locates the push button in a first unseated position wherein both the opening and the metered orifice are opened. Further movement of the push button locates the push button in a second unseated position wherein the metered orifice is left open while the opening is manually closed.

A one-way valve positioned over the exhaust port prevents the flow of water into the collection chamber through the exhaust port. Another one-way valve positioned over the fluid inlet prevents water from flowing out of the collection chamber through the fluid inlet. Further, when the actuator port is closed, i.e., the push button is in its seated position, an air lock is created in the collection chamber which prevents water from entering the collection chamber through the inlet. Accordingly, when the collection chamber is submerged and the actuator port is closed, the combined effect of an air lock in the chamber and the one-way valve over the exhaust port prevents water from entering the collection chamber. On the other hand, when the collection chamber is submerged and only the metered orifice is opened, i.e., the push button is manipulated into its second unseated position, the resultant breaking of the air lock and the controlled release of air from the chamber allows water and debris to enter the collection chamber through the fluid inlet. Draining of the collection chamber is accomplished by merely withdrawing the collection chamber from the pool. In doing so, negative fluid pressure created in the chamber causes the push button to locate in its first unseated position, wherein both the opening and metered orifice of the actuator port are open. This facilitates draining of water from the chamber through the exhaust port.

The novel features of this invention, as well as the invention itself, both as to its structure and its operation will be best understood from the accompanying drawings, taken in conjunction with the accompanying description, in which similar reference characters refer to similar parts, and in which:

DESCRIPTION OF THE PREFERRED EMBODIMENT

Figure 1:
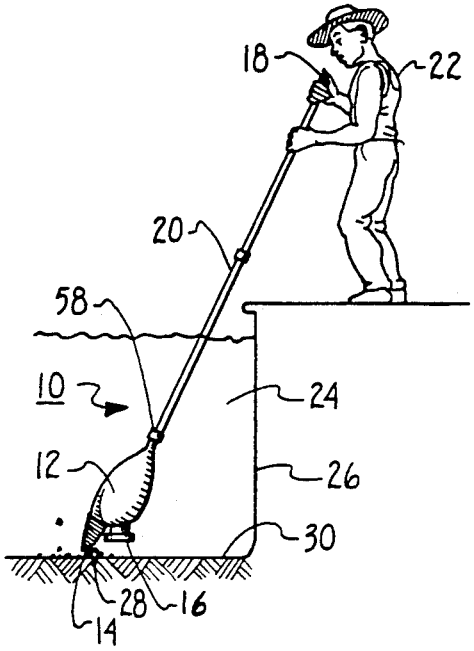
FIG. 1 is a perspective view of the underwater vacuum cleaner of the present invention shown with its collection chamber in a submerged condition.
Figure 2:
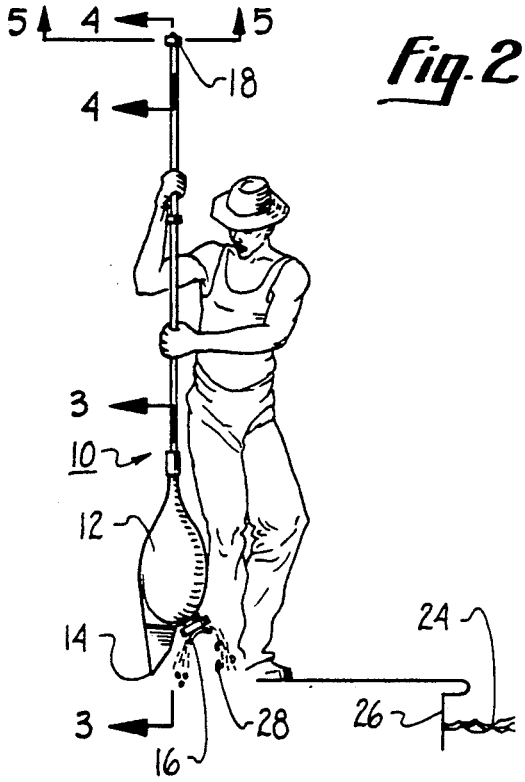
FIG. 2 is a perspective view of the underwater vacuum cleaner of the present invention shown with its collection chamber withdrawn from a pool.

Referring initially to FIG. 1, an underwater vacuum cleaner in accordance with the present invention is shown in its intended environment and is generally designated 10. As shown, the vacuum cleaner 10 includes a collection chamber 12 which has an associated fluid inlet 14, an exhaust port 16 and an actuator port 18. More specifically, the collection chamber 12 is a generally bulbous structure which has the fluid inlet 14 and the exhaust port 16 formed directly on the structure. On the other hand, the actuator port 18 is distanced from the collection chamber 12 by a long hollow extension tube 20 which connects the actuator port 18 in fluid communication with the collection chamber 12. Due to the length of the tube 20, a user 22 is able to submerge the collection chamber 12 of vacuum cleaner 10 into the water 24 of pool 26 to remove any dirt and debris 28 that has accumulated on the bottom 30 of pool 26. Also, as indicated in FIG. 2, user 22 is able to retrieve collection chamber 12 from the pool 26 by pulling on tube 20.

Figure 3A:
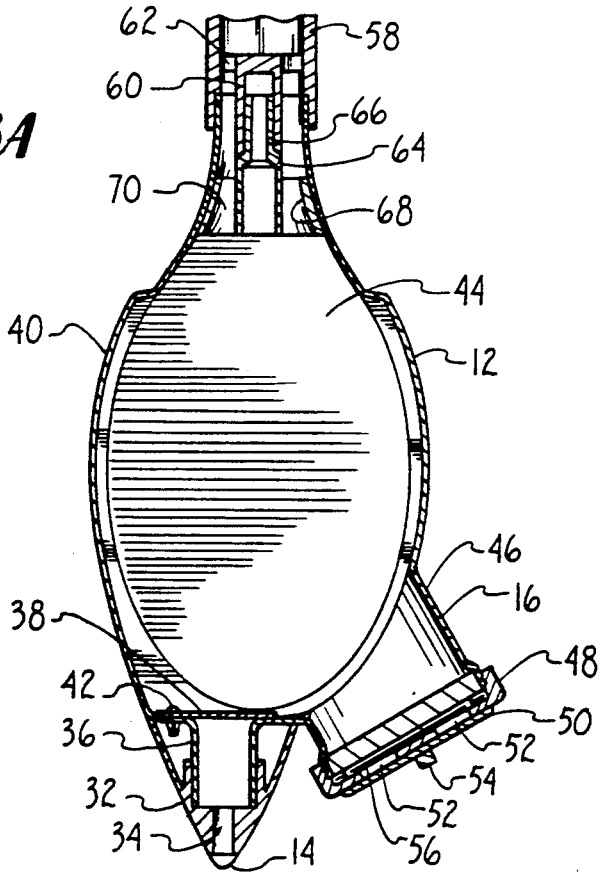
FIG. 3A is a cross-sectional view of the collection chamber of the present invention as would be seen along the line 3—3 in FIG. 2 when the collection chamber is submerged and an air lock is established in the collection chamber.

The details of collection chamber 12 will, perhaps, be better appreciated with reference to FIG. 3A where it will be seen that the inlet port 14 is established by a nozzle 32. As shown, the nozzle 32 is formed with a fluid passageway 34 and is attached to an extension tube 36 of collection chamber 12 by any means well-known in the pertinent art, such as by gluing. Further, fluid inlet port 14 includes a flapper 38 which is attached to the wall 40 by means, such as bolt 42, to cover the opening between fluid inlet 14 and the interior 44 of collection chamber 12. As will be appreciated by the skilled artisan, flapper 38 effectively establishes a one-way valve which prevents water 24 in the interior 44 of collection chamber 12 from leaving collection chamber 12 via the fluid inlet 14.

Still referring to FIG. 3A, it will be seen that the exhaust port 16 is formed by a relatively short open-ended conduit 46 which extends from collection chamber 12. A cap 48, formed with a plurality of holes 52, is threadably engageable with the conduit 46 to cover its opening and a resilient disk 50 is attached to the cap 48, by any means known in the art, such as by a knob 54. With the resilient disk 50 positioned on cap 48 as shown in FIG. 3A, disk 50 establishes an effective one-way valve which will prevent water 24 from entering the interior 44 of collection chamber 12 through exhaust port 16. FIG. 3A also indicates that a removable filter 56 is engageable with cap 48 to be held across the opening of conduit 46 substantially as shown. When so positioned, filter 56 prevents any debris 28 in collection chamber 12 from leaving interior 44 as water 24 is drained from the collection chamber 12.

By cross-referencing FIG. 1 with FIG. 3A it will be seen that hollow extension tube 20 is held in fluid communication with collection chamber 12 by a connector 58. For purposes of the present invention, tube 20 can be engaged with connector 58 by any means well-known in the art, such as 24 by a friction or interference fit. On the other hand, in order to ensure a sturdy connection between connector 58 and collection chamber 12, a different structure is required. Specifically, and as best seen in FIG. 3A, the connector 58 is formed with a hollow tubular shaped engager 60 which is positioned in the connector 58 to establish fluid passageways 62 through the connector 58. Also shown is a connector retainer 64 which is formed with a probe 66 that is engageable with the engager 60 to hold connector 58 in contact with connector retainer 64. It will be seen that connector retainer 64 is also formed with vanes 68 which are held against the inside of wall 40 to hold the connector retainer 64 in collection chamber 12. Importantly, the vanes 68 of connector retainer 64 provide for fluid passageways 70 which establish fluid communication between the interior 44 of collection chamber 12 and the extension tube 20.

Figure 4A:
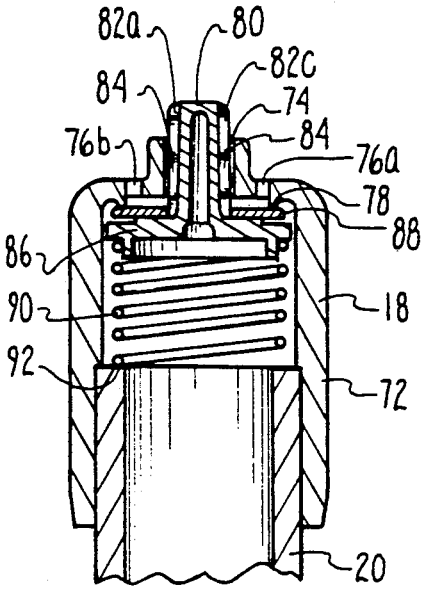
FIG. 4A is a cross-sectional view of the actuator port of the present invention as seen along the line 4—4 in FIG. 2 with the actuator port in a configuration corresponding to the condition of the collection chamber shown in FIG. 3A.

Referring now to FIG. 4A it will be seen that the actuator port 18 of vacuum cleaner 10 includes a housing 72 which is attached to the protruding end of extension tube 20. Attachment of the actuator port 18 with tube 20 may be by any means well-known in the art, such as by gluing or solvent bonding. Importantly, however, the attachment of actuator port 18 with tube 20, like all other connections disclosed for vacuum cleaner 10, must be airtight.

FIG. 4A also shows that the housing 72 of actuator port 18 is formed with a central opening 74 and at least one metered orifice 76, such as the metered orifices 76 a, b shown in the drawings. Further, housing 72 is formed with a valve seat 78 which circumscribes both central opening 74 and the metered orifice 76 a, b. A push button 80, which is formed with flanges 82, is slidably disposed in the opening 74 to establish air passageways 84 through opening 74. Additionally, push button 80 is formed with a circular plate 86 which reciprocates with push button 80 as push button 80 is moved back and forth in the opening 74. A washer seal 88 is positioned on plate 86 of push button 80, substantially as shown, in order to establish sealing engagements with valve seat 78 of housing 72. Also, a spring 90 is disposed in compression between the end 92 of extension tube 20 and the side of plate 86 which is opposite washer seal 88 to urge washer seal 88 into its sealing engagement with valve seat 78. Importantly, the spring constant for spring 90 should be relatively low in order to allow for the disengagement of the washer seal 88 from valve seat 78 with a relatively small force.

Figure 4B:
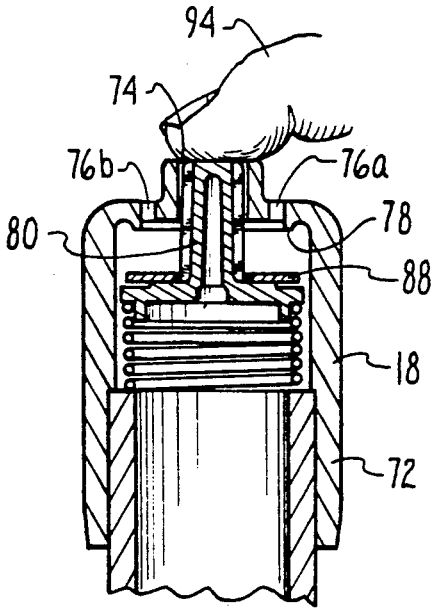
FIG. 4B is a cross-sectional view of the actuator port of the present invention as seen along the line 4—4 in FIG. 2 with the actuator port in a configuration corresponding to the condition of the collection chamber shown in FIG. 3B.
Figure 4C:
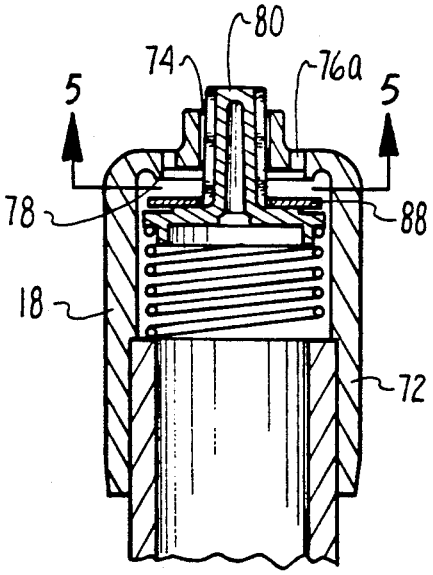
FIG. 4C is a cross-sectional view of the actuator port of the present invention as seen along the line 4—4 in FIG. 2 with the actuator port in a configuration corresponding to the condition of the collection chamber shown in FIG. 3C.
Figure 5:
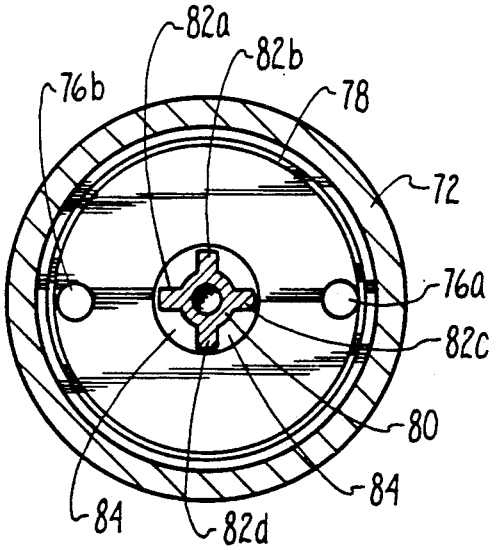
FIG. 5 is a cross-sectional view of the actuator port of the present invention as seen along the line 5—5 in FIG. 2 from the location indicated by the line 5—5 in FIG. 4C.

The flow of air through actuator port 18 to and from extension tube 20 through actuator port 18, and hence to and from collection chamber 12, will be best appreciated by cross referencing FIGS. 4A, 4B and 4C with FIG. 5. With washer seal 88 urging against valve seat 78 as shown in FIG. 4A, an airtight seal is created which effectively closes the actuator port 18. When push button 88 is depressed into the position shown in FIG. 4B, however, the metered orifices 76 a, b are opened even though the opening 74 may be closed by a digit 94 of user 22. As is to be appreciated by the skilled artisan in reference to FIG. 5, metered orifices 76 a, b can be sized or dimensioned in relation to the displacement volume of the interior 44 of collection chamber 12 to control the rate at which water 24 is able to enter collection chamber 12 when opening 74 is closed. With push button 80 positioned as shown in FIG. 4C, as will happen when vacuum cleaner 10 is withdrawn from pool 28 and held by user 22 as shown in FIG. 2, both the opening 74 and the metered orifices 76 a, b are opened. This configuration for the push button 80 happens because, as a water-filled collection chamber 12 is removed from a pool 26, water 24 drains from the vacuum cleaner 10 through exhaust port 16 and creates a negative pressure force on plate 86 which pulls push button 80 into the position shown.

OPERATION

In the operation of the vacuum cleaner 10, an empty vacuum cleaner 10 is submerged into the water 24 of a pool 26 and inlet 14 of collection chamber 12 is positioned near debris 28 to be removed from the bottom 30 of pool 26. As collection chamber 12 is submerged, user 22 does not activate or move push button 80 of actuator port 18. Consequently, spring 90 urges washer seal 88 against valve seat 78 to close actuator port 18. This is the seated position for push button 80. Further, as collection chamber 12 is submerged, the resilient disk 50 which creates a one-way valve for exhaust port 16 prevents water 24 from entering the collection chamber 12 through exhaust port 16. The result is an air lock within the collection chamber 12 that also prevents water 24 from entering collection chamber 12 through fluid inlet 14. During this portion of the operation, the configuration of collection chamber 12 is as shown in FIG. 3A and the configuration of actuator port 18, i.e., the seated position for push button 80, is as shown in FIG. 4A.

Figure 3C:
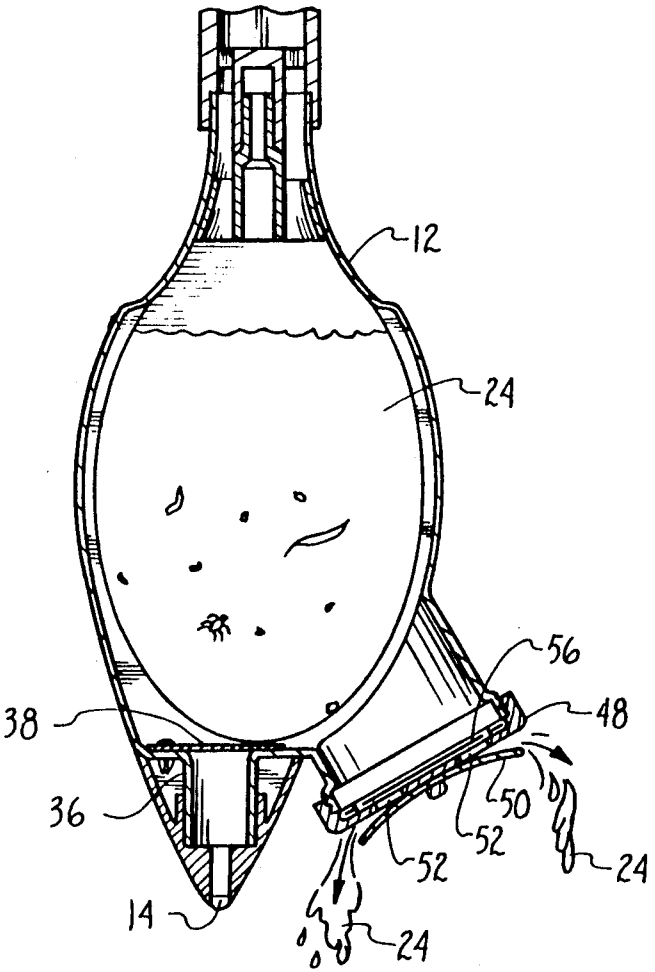
FIG. 3C is a cross-sectional view of the collection chamber of the present invention as seen along the line 3—3 in FIG. 2 while water is draining from the collection chamber.
Figure 3B:
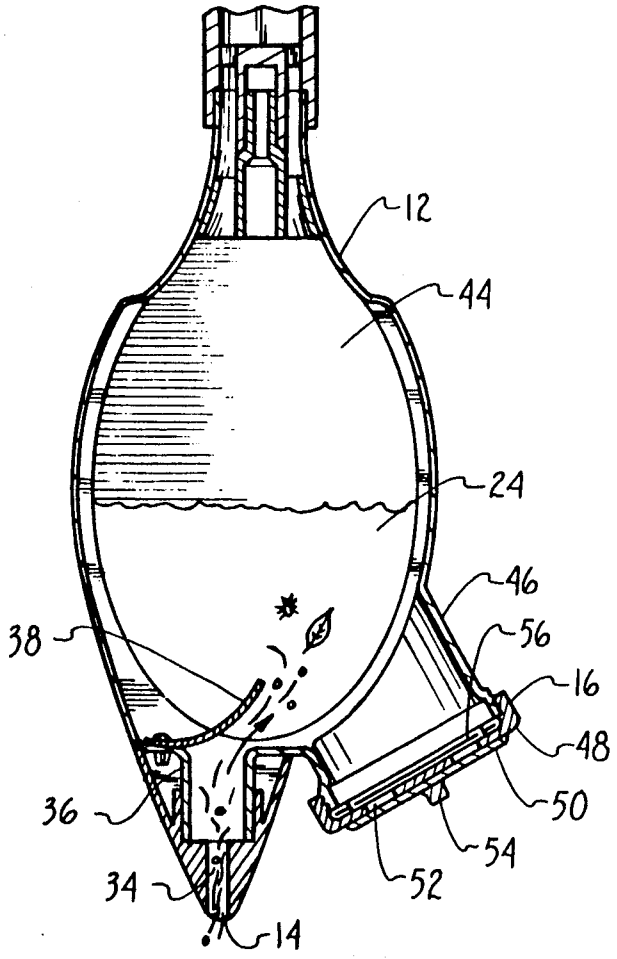
FIG. 3B is a cross-sectional view of the collection chamber of the present invention as would be seen along the line 3—3 in FIG. 2 when the collection chamber is submerged and the collection chamber is filling with water.

The activation of actuator port 18 by movement of push button 80 into an unseated position as shown in FIG. 4B breaks the air lock in collection chamber 12 and allows water 24 to flow into the interior 44 of collection chamber 12 as shown in FIG. 3B. Specifically, with this movement of push button 80 into its second unseated position, the opening 74 is closed and the washer seal 88 is disengaged or unseated from the valve seat 78. Importantly, during this vacuuming stage of the operation, user 22 closes opening 74 of actuator port 18 with a digit 94 to direct air flow in actuator port 18 through the metered orifices 76 a, b. The resultant selectively controlled release of air from collection chamber 12 through metered orifices 76 a, b causes water 24 and debris 28 to enter collection chamber 12 at a predictable rate through fluid inlet 14. This flow of fluid into the collection chamber 12 is of a relatively extended duration due to the volume of the interior 44 of collection chamber 12 in its relation to the size of the fluid inlet 14. As will be appreciated by the skilled artisan, collection chamber 12 can be of any size which, when filled with water can be effectively handled by a user 22. Further, it will be understood that resilient disk 50 prevents water 24 from entering collection chamber 12 through exhaust port 16 during this stage of the operation.

Once collection chamber 12 is filled with water 24 and has ingested debris 28 along with this water 24, collection chamber 12 is withdrawn from pool 26. This withdrawal of collection chamber 12 causes push button 80 to assume a position in actuator port 18 substantially as shown in FIG. 4C and causes a configuration for collection chamber 12 which is substantially as shown in FIG. 3C. The position of push button 80, as shown in FIG. 4C, is its first unseated position. When push button 80 is in its first unseated position, both opening 74 and metered orifices 76 a, b are open or patent. This allows air to rapidly enter collection chamber 12 through actuator port 18 to facilitate the drainage of water 24 from collection chamber 12. As indicated above, push button 80 assumes the first unseated position shown in FIG. 4C due to the negative pressure which is established in collection chamber 12 as water 24 drains from collection chamber 12 through exhaust port 16. FIG. 3B also shows that water 24 can only be drained from collection chamber 12 through exhaust port 16. This is due to the one-way valve effect of flapper 38 which is held closed over fluid inlet 14 during the draining procedure by pressure from water 24 within interior 44. As can be appreciated by reference to any of the FIGS. 3 A, B or C, the collection chamber 12, when held by a user 22 as shown in FIG. 2, assumes an inverted Y-shape configuration. This Y-shape configuration is important for the reason that, with flapper 38 closed, all of the water 24 which has been drawn into collection chamber 12 will be diverted through exhaust port 16. Consequently, any debris 28 which was collected with water 24 while water 24 was being drawn into collection chamber 12 will be caught by the filter 56 of exhaust port 16 as water 24 is being drained from the collection chamber 12. Importantly, no water 24 will be left in collection chamber 12. Once the collection chamber 12 has been emptied, cap 48 can be removed from exhaust port 16 and the filter 56 cleaned of debris 28. Cap 48 can then be reengaged with exhaust port 16 and the entire procedure repeated as necessary.

While the particular underwater vacuum cleaner as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. An underwater vacuum cleaner for removing debris from a pool which comprises:

a hollow submersible collection chamber having a fluid inlet and an actuator port including an opening and a metered orifice;

sealing means for closing said opening and said orifice of said actuator port to create an air lock in said chamber and prevent the flow of water into said chamber through said inlet when said chamber is submerged; and means for selectively unseating said sealing means to break said air lock and cause water to enter said chamber through said inlet including a manually operable push button reciprocally mounted in said opening of said actuator port for movement between a seated position wherein said opening and said orifice are closed by said sealing means, a first unseated position wherein said opening and said orifice are open, and a second unseated position wherein said opening is closed and said orifice is open.

2. An underwater vacuum cleaner as recited in claim 1 further comprising an exhaust port formed on said collection chamber for draining water therefrom when said collection chamber is removed from said pool and said sealing means is unseated from said actuator port.

3. An underwater vacuum cleaner as recited in claim 2 wherein said metered orifice is a hole dimensioned in proportion to the fluid volume of said collection chamber to control the rate of water flow through said inlet into said collection chamber when said collection chamber is submerged and said push button is in said second unseated position.

4. An underwater vacuum cleaner as recited in claim 2 further comprising a filter positioned across said exhaust port to trap said debris as water is drained from said collection chamber.

5. An underwater vacuum cleaner as recited in claim 2 further comprising:

a one-way valve mounted on said chamber over said exhaust port to prevent water flow through said exhaust port while said air lock is effective; and a one-way valve mounted on said chamber over said inlet to prevent water flow from said collection chamber through said inlet.

6. An underwater vacuum cleaner as recited in claim 2 further comprising a hollow tube connecting said actuator port in fluid communication with said collection chamber.

7. An underwater vacuum cleaner as recited in claim 2 wherein said push button is spring-loaded to urge said sealing means into said seated position.

8. An underwater vacuum cleaner which comprises:

a hollow submersible collection chamber formed with a fluid inlet, an exhaust port and an actuator port including an opening and a metered orifice;

a push button; and a seal attached to said push button, with said push button being reciprocally mounted on said cleaner for movement between a seated position wherein both said opening and said metered orifice of said actuator port are closed by said seal to establish an air lock in said chamber and prevent water from entering said chamber when said chamber is submerged, and an unseated position wherein said seal is distanced from said actuator port to break said air lock and allow water to flow through said collection chamber and both said opening and said orifice are open and a second unseated position wherein said opening is closed and said metered orifice is open.

9. An underwater vacuum cleaner as recited in claim 8 wherein said metered orifice is a hole dimensioned in proportion to the fluid volume of said collection chamber to control the rate of fluid flow through said inlet into said collection chamber when said push button is in said second unseated position.

10. An underwater vacuum cleaner as recited in claim 8 further comprising:

a one-way valve mounted on said chamber over said exhaust port to prevent water flow through said exhaust port while said air lock is effective;

a one-way valve mounted on said chamber over said inlet to prevent water flow from said collection chamber through said inlet; and a filter positioned across said exhaust port to trap debris as water is drained from said collection chamber.

11. An underwater vacuum cleaner as recited in claim 8 further comprising a hollow tube connecting said actuator port in fluid communication with said collection chamber and wherein said push button is spring-loaded to urge said sealing means into said seated position.

* * * * *